US005325570A

United States Patent [19]

Chin-Ho

[11] Patent Number: 5,325,570

[45] Date of Patent: Jul. 5, 1994

[54] CLIP

[76] Inventor: Hsu Chin-Ho, No. 37, Sec. 1, Hanna Koou Rd., Taichung City, Taiwan

[21] Appl. No.: 114,026

[22] Filed: Aug. 30, 1993

[51] Int. Cl.[5] ..... A44B 21/00

[52] U.S. Cl. ..... 24/530; 24/511

[58] Field of Search ..... 24/530, 501, 509, 511, 24/462, 570, 571, 499, 482, 523, 543

[56] References Cited

U.S. PATENT DOCUMENTS

| | | | |
|---|---|---|---|
| 2,525,985 | 10/1950 | Weymouth | 24/511 |
| 2,666,240 | 1/1954 | Maccaferri | 24/501 |
| 3,456,262 | 7/1969 | Coon | 24/511 |
| 4,514,885 | 5/1985 | Delahousse et al. | 24/543 |
| 4,660,750 | 4/1987 | Blanchard | 24/501 |
| 5,052,085 | 10/1991 | Gau | 24/511 |
| 5,075,935 | 12/1991 | Abdi | 24/511 |

*Primary Examiner*—Victor N. Sakran

[57] ABSTRACT

An improved clip, includes two interconnected clip bodies which each is a miror image of the other and which are formed integrately, the supporting point for the pressure action is exactly the connection of the two bodies, a groove is formed between the force action arm of each body and each side of the supporting point, the grooves suit a U shaped spring strip which presses the force action arms of the bodies to render the clamping arms on the opposite ends of the bodies capable of clamping an article.

4 Claims, 2 Drawing Sheets

CLIP

BACKGROUND OF THE INVENTION

The present invention relates to an improved clip, especially to the improvement in a clothes clip.

A conventional clothes clip, such as shown in FIG. 1, comprises mainly two separated clip bodies which are pressed to close their arms by a pressure spring; it has the following drawbacks: 1. the two bodies are separated, they need to be aligned., besides, two arms of the pressure spring must be forced into the grooves provided in the bodies, and this is a very hard work to assemble into the grooves; 2. when in use, the clip bodies are subjected to being disconnected due to the structural weakness of the clip.

In view of this, the inventor studied and improved the structure of the clip, and finally produces the present invention, a renovated clip.

SUMMARY OF THE INVENTION

The principle object of the present invention is to provide an integrated moulded clip structure which is not subjected to being disconnected.

The feature of the present invention is: the clip includes two interconnected clip bodies which each is a miror image of the other and which are formed integrately, the supporting point for the pressure action is exactly the connection of the two bodies, a groove is formed between the force action arm of each body and each side of the supporting point, the grooves suit a U shaped spring strip which presses the force action arms of the bodies to render the clamping arms on the opposite ends of the bodies capable of clamping an article.

The present invention will be apparent after reading the detailed description of the preferred embodiment thereof in reference to the accompanying drawings.

DESCRIPTION OF THE PREFERRED EMBODIMENT DETAILED

Figure 2:
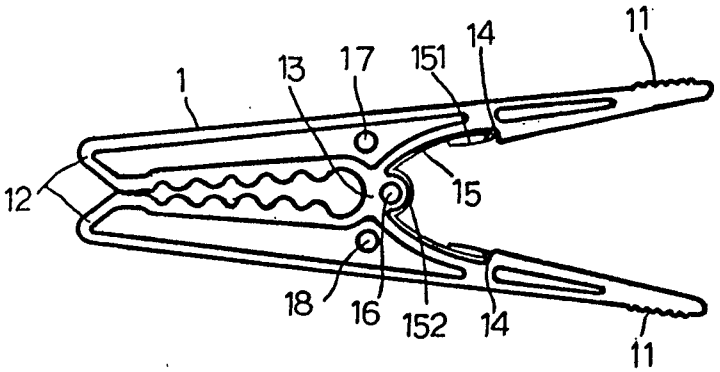
FIG. 2 is a plane view of the present invention.
Figure 1:
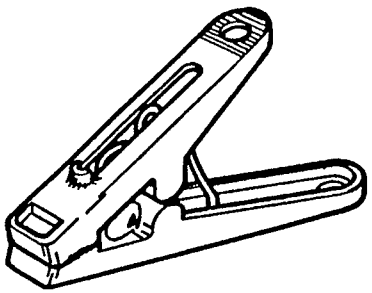
FIG. 1 (PRIOR ART)
FIG. 1 shows a conventional clip.
Figure 3:
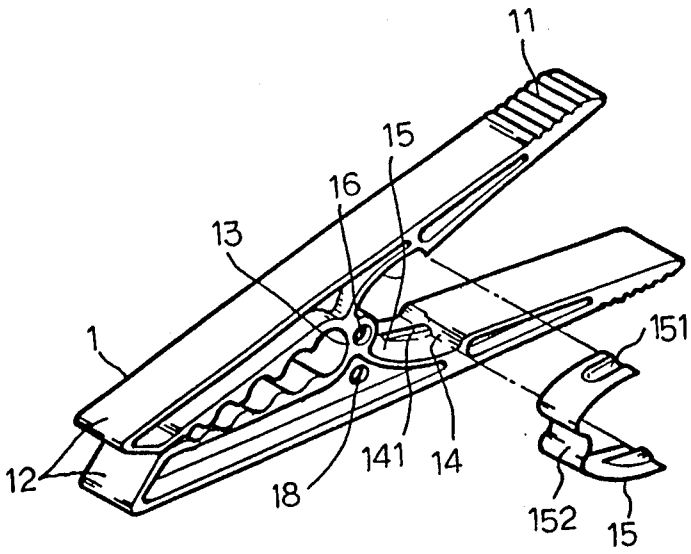
FIG. 3 is a perspective analytic view of the present invention.

Referring to FIG. 2 and 3, wherein two clip bodies 1 are integrately formed which each includes a force action arm 11 and a clamping arm 12, a supporting point as well as connection 13 is provided between the force action arm 11 and the clamping arm 12; There are two embedding grooves 14 formed between the sopporting point 13 and the two force action arms 11, a U shaped spring strip 15 is embedded in each groove 14, the pressing forces of the spring strip 15 presse the force action arms 11 in two mutually opposite directions to render the clamping arms 12 to clamp an article.

A tenon 141 is provided in each groove 14, and a recess 151 is provided at each end of the spring strip 15, which recesses 151 well match with the tenons 141, so that the spring strip 15 can be embedded into the grooves 14 with the recesses 151 thereof fit to the tenons 141, in this case, the spring strip 15 may not be moved or drop off.

The sopporting point or connection 13 has excellent tenacity and elasticity, it can endure for a very long time usage without a crack.

A hole 16 can be provided on the supporting point 13 or at an appropriate position on one side of the supporting point 13, and there is a recess 152 provided on the top outside surface of the spring strip 15. The hole 16 can be put on a clothes hanger. While the recess 152 is abutted against the connection 13, so that the spring strip 15 can not be moved or drop off either. Also at some suitable positions there are holes 17 and 18 to allow more selections of holes for the hanger when in use.

Accordignly, the present invention provides an integrated and combined body which is not separable, and When in assembling, it needs only to aligne the spring strip 15 with the embedding groove 14, the assembling work is very convenient and fast, yet the assembly is practical for use.

My invention may assume numerous forms and is to be construed as including all modifications and variations falling within the scope of the appended claims.

Having thus described my invention, what I claim as new and desire to be secured by Letters Patent of the United States is:

1. An improved clip, said clip is characterized in that: said clip including two interconnected clip bodies which each being miror image of the other and being formed integrately, each of said bodies having a force action arm and a clamping arm, the supporting point for the pressure action being exactly the connection of said two bodies, a groove being formed between said force action arm of each body and each side of said supporting point, said grooves, suit a U shaped spring strip which presses outward on said force action arms of said bodies to render said clamping arms of each body capable of clamping an article.

2. An improved clip as stated in claim 1, wherein, a tenon being provided in each said groove, and a recess being provided at each end of said spring strip, said recess well matching with said tenon such that said spring strip being able of embedding into said grooves with said recess fit to said tenons, in this case, said spring strip being not moved or dropping off.

3. An improved clip as stated in claim 1, wherein, a hole for a clothes hanger being provided on said supporting point or at an appropriate position on one side of said supporting point, and another recess being provided on the top outside surface of said spring strip which is abutted against said connection, so that said spring strip being not moved or dropping off.

4. An improved clip as stated in claim 1, wherein, a plurality of other holes for clothes hanger being provided at appropriate positions on said bodies.

* * * * *